United States Patent [19]

Obenchain

[11] 4,009,870

[45] Mar. 1, 1977

[54] METALLURGICAL SHAFT FURNACE

[76] Inventor: Richard F. Obenchain, 3340 Comanche Road, Pittsburgh, Pa. 15241

[22] Filed: June 22, 1976

[21] Appl. No.: 698,355

[52] U.S. Cl. ..... 266/192; 266/197; 266/280

[51] Int. Cl.[2] ..... C21B 7/10; C21B 7/02

[58] Field of Search ..... 75/38–41, 75/43, 44 R, 44 S; 266/190, 192–194, 197–199, 280, 283, 219, 900

[56] References Cited

UNITED STATES PATENTS 964,885 7/1910 Scott ..... 266/192

*Primary Examiner*—Gerald A. Dost

*Attorney, Agent, or Firm*—Parmelee, Miller, Welsh & Kratz

[57] ABSTRACT

A metallurgical shaft furnace for producing metal from a charge which enhances the preheating capacity of upwardly flowing gases in an upper preheating portion of the furnace, the upper portion being formed from concentric sections which increase in diameter from the uppermost section to the lowermost section of the preheating portion of the furnace. Troughs are formed where adjacent sections meet to form cooling rings around the upper portion, the rings projecting inwardly from the furnace wall. The lower portion comprises a melting portion having tuyeres, a hearth and tap means. Vertical cooling conduits may be provided in the lower section with conduits adjacent each tuyere terminating above the tuyere to prevent damage to the conduits.

16 Claims, 4 Drawing Figures

FIG. 2.
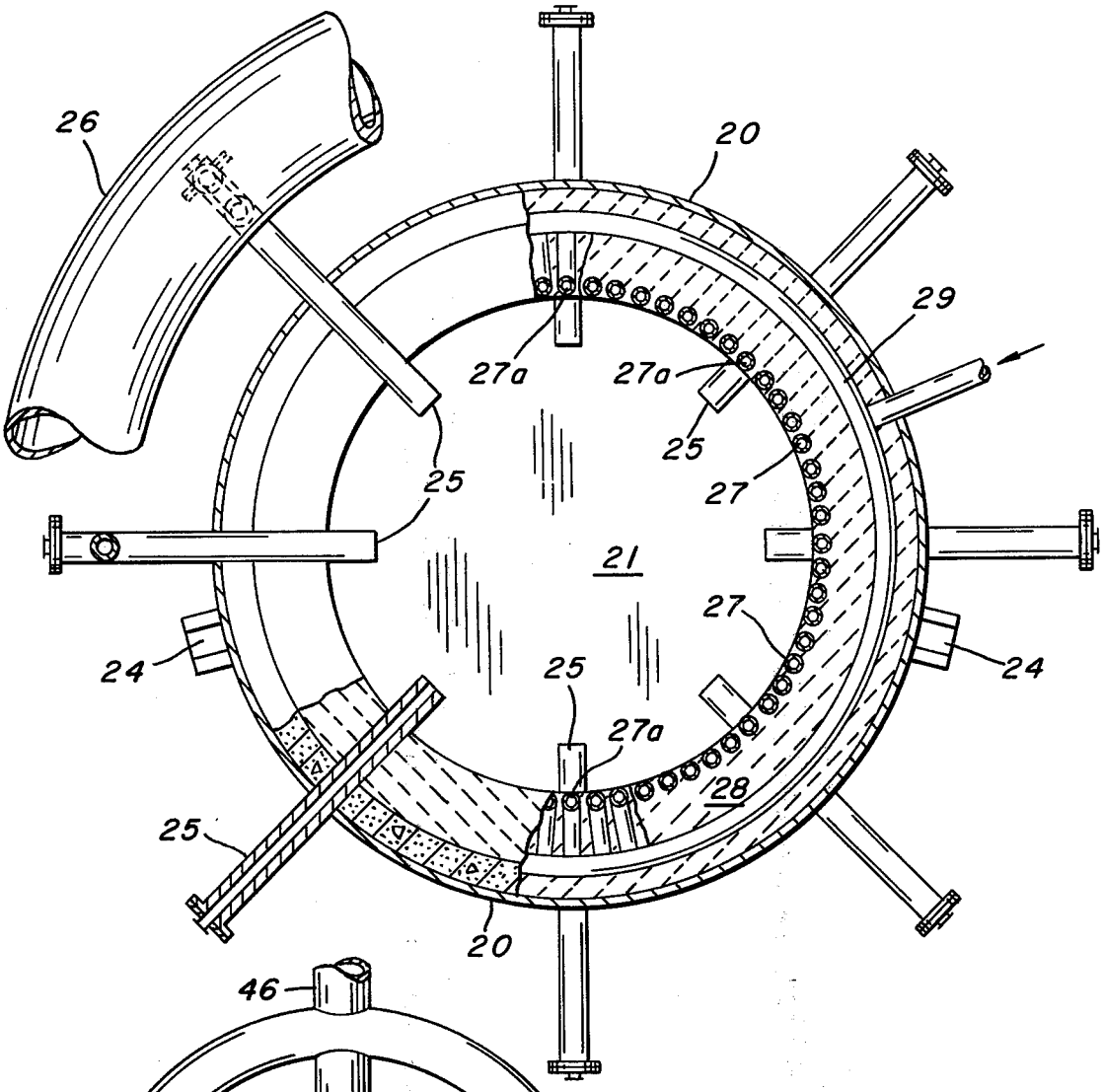
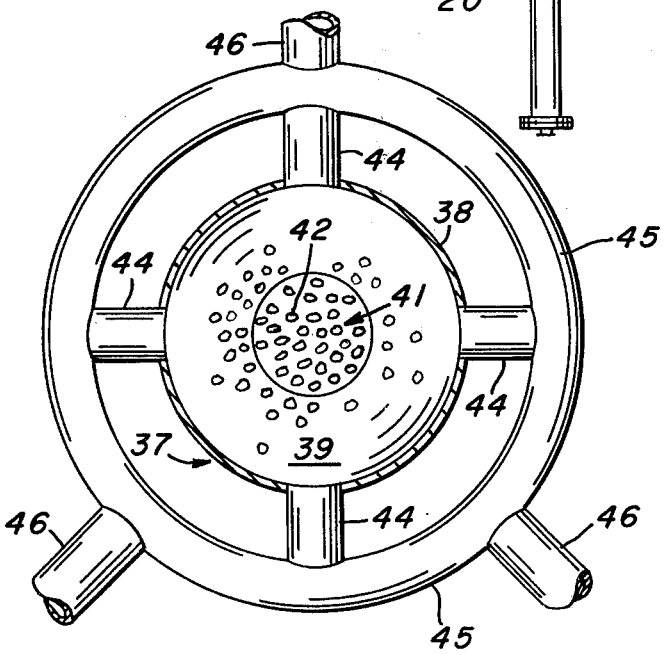
FIG. 4.

METALLURGICAL SHAFT FURNACE

BACKGROUND OF THE INVENTION

The present invention relates to a metallurgical shaft furnace usable to produce molten metal from a charge, such as a blast furnace or a cupola-type furnace. Generally, cupola-type furnaces were used for the melting of scrap or other metallic material, with only the application of air to an incandescent coke bed providing heat for the melting. More recently, however, with the formation of carbonaceous-containing metal oxide pellets and charging the same along with coke and flux, the use of cupola-type furnaces for the reduction of agglomerated metal oxides has become practical, such as is disclosed in my U.S. Pat. No. 3,832,158, issued Aug. 27, 1974.

With the use of a relatively small and uniform charge of material in a shaft furnace, a problem has arisen in that, because of the relative uniformity of the charge, hot ascending gases from the lower melting portion of the furnace tend to escape up along the sides of the furnace. The passage of these gases, which pass upwardly along the periphery of the shaft, is termed herein as "channeling." The present invention provides a furnace construction wherein such channeling is reduced and cooling provided to the walls of the upper portion of the furnace, while hot gases are directed towards the central region of the charge. In addition, the gases are deflected away from the furnace shell, reducing the heat on the shell, thus making it easier to cool. Cooling may be accomplished with air or water.

SUMMARY OF THE INVENTION

An improved metallurgical furnace, having a conventional hearth at the bottom of the furnace with a conventional tuyere arrangement, with means for preventing channeling of hot gases upwardly along the periphery, thus providing a more uniform passage of gases throughout a cross-section of the furnace. The furnace has an upper preheating portion and a lower melting portion. The upper portion of the furnace is comprised of concentric sections which increase in diameter from the uppermost section to the lowest section. At the juncture of adjacent sections, a water trough is formed which extends inwardly to form a cooling ring that is provided with cooling water external of the furnace. The rings also provide support for a portion of the charge fed to the furnace to prevent channeling of gases up the interior wall of the furnace. Gases are thus directed to the bulk of the charge. In one embodiment, the gases are exhausted through an exhaust conduit at the center of the uppermost section, while in a further embodiment, gases are removed from the sides of the uppermost section. The lower portion may be formed from spaced vertical cooling conduits, the major portion of which terminate short of the hearth of the furnace while cooling conduits in close proximity to the tuyeres are shorter and terminate at a position above the tuyeres.

BRIEF DESCRIPTION OF THE DRAWINGS

FIG. 2 is a view taken along the lines II—II of FIG. 1;

FIG. 4 is a view taken along the lines IV—IV of FIG. 3.

DETAILED DESCRIPTION

Figure 1:
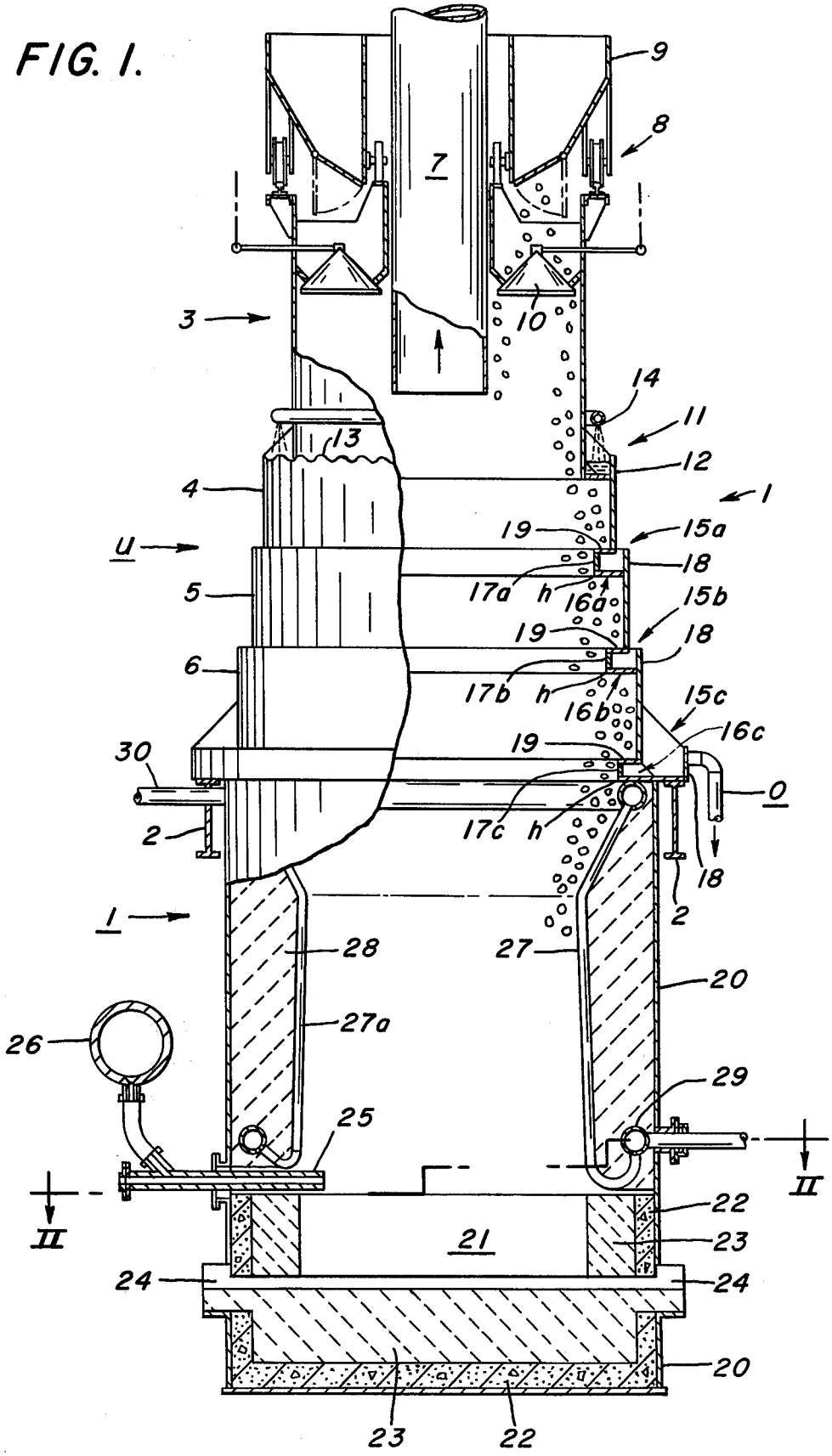
FIG. 1 is a side elevational partial cross-sectional view of a cupola-type furnace of the present invention.

Referring now to FIG. 1, there is illustrated an improved metallurgical furnace 1, having an upper portion *u* and a lower portion 1. In the drawing, the two portions are interconnected at a suspension means 2, such as a support ring, although other support means may be used, such as a base or legs under the melting section of the furnace. With such a preferred suspended arrangement, the upper portion *u* is free to expand in an upward direction while the lower portion 1 can expand in a downward direction under the extreme temperature variations encountered during operation or shutdown of the furnace. With such an arrangement, the furnace is also suspended from the floor of the operation area for easy access. The entire furnace, both the upper and lower sections are, of course, interconnected airtight shells to enable control of the interior gaseous content of the furnace.

The upper portion *u* or preheating portion of the furnace is formed of concentric sections 3, 4, 5 and 6 formed of metal, with the uppermost or charging section 3 having one diameter while the other sections, in descending order each have a larger diameter than the upper adjacent section. Thus, the diameter of each section increases in size from charging section 3 to section 6 at the suspension means 2. The walls of the sections are shown vertical but may also be tapered so as to provide sections in the shape of truncated cones. The charging section 3, as illustrated in the embodiment, has a central exhaust conduit 7 positioned therein for exhausting of hot gases from the furnace and is provided with a charging means 8, around the exhaust conduit 7 for charging of a pelletized or sized charge to the furnace. The charging means, such as charging cars 9 and atmospheric sealing means 10 enable uniform charging of a charge such as agglomerates to the furnace around the interior area of the furnace. Such charging, around the exhaust conduit 7 also directs hot gases from the furnace to the exhaust conduit for removal. However, other exhaust means and charging means may be employed.

A water channel 11 is formed at the connection of charging section 3 and the adjacent section 4, by means of a wall 12 which extends around the furnace. As illustrated, the wall is preferably formed as a serrated wall, with serrations 13, to enable easy overflow of water from the channel 11, with water fed to the channel 11 by water jets or sprays 14, with the water preferably fed as a tangential stream causing a circular stream around the trough.

Troughs 15*a*, 15*b*, and 15*c* are also provided between adjacent sections 4–5, 5–6 and between section 6 and the lower portion 1 of the furnace, which troughs extend inwardly at 16*a*, 16*b*, and 16*c* to form rings 17*a*, 17*b*, and 17*c* that extend into the interior of the upper portion *u* of the furnace. The troughs 15*a*, 15*b*, and 15*c* also have walls 18 to retain a quantity of water and provide cooling for the furnace wall. With the sections 4, 5, and 6 increasing in diameter relative to each other, the rings 17*a*, 17*b* and 17*c* also increase in diameter, although each is inwardly directing relative to the interior of the furnace. The wall 18 around trough 15*c* has an overflow conduit *o* to direct water from the trough for disposal or reuse.

The rings 17*a*, 17*b*, and 17*c*, because they are inwardly directed, form ledges 19 that retain a portion of a charge to the furnace and, because of the inward direction of the rings, gases flowing upwardly along the inside wall of the furnace are directed inwardly to the center of the furnace and channeling is prevented along the walls. When the furnace is in operation, water sprays 14 direct water tangentially around channel 11, which water, upon filling the trough, overflows and cascades down the side of section 4 to trough 15*a*, thence upon overflowing, down the side of section 5 to trough 15*b*, thence down the side of section 6 to trough 15*c* where it is finally removed through overflow conduit *o*. The hot points *h* of rings 17*a*, 17*b*, 17*c* and trough 11 are thus continuously in contact with a flow of cooling water, as are the exterior of the walls of sections 4, 5 and 6.

The lower portion 1 of the furnace may be constructed as a conventional cupola furnace melting zone, except that, in the illustrated embodiment, an improved cooling means is provided. The lower portion 1 has a metallic shell 20 which has at the bottom thereof a hearth portion 21. The hearth 21 is formed from an insulating cement base 22 and a refractory lining 23 with tap holes 24 provided for tapping a melt therefrom. Above the hearth 21 are located tuyeres 25, with a conventional bustle pipe 26 feeding the tuyeres. The lower portion 1 of the furnace between the hearth 21 and the suspension means 2 is, of course, that portion of the furnace subject to the highest temperatures and, for this reason, the provision of cooling means may be desired. Cooling means are provided around the wall of the melting section above the tuyeres, such as with horizontal or helical cooling tubes, with vertical cooling tubes illustrated. As illustrated in FIGS. 1 and 2, the cooling means comprises a series of spaced vertical cooling conduits 27 around the interior and spaced from the vertical portion of the shell 20. An insulating cement 28 is provided between the conduits 27 and shell 20, while a feed header 29 feeds water to the conduits for upward flow, with the water than discharged through discharge header 30.

An important aspect of the improved illustrated lower section 1 of the present furnace, illustrated in FIGS. 1 and 2, is the variation in length of conduits 27. As shown, the major portion of conduits 27 extend from adjacent the suspension means 2 to a position spaced from the hearth 21, while those vertical conduits 27, such as 27*a*, that are adjacent the tuyeres 25 are shorter than the major portion of conduits and terminate in a spaced relationship to the tuyeres 25. This variation in length of the vertical cooling conduits 27 prevents burning out of those conduits 27*a* adjacent the tuyeres which could result due to the intense heat of the area of the tuyeres.

Figure 3:
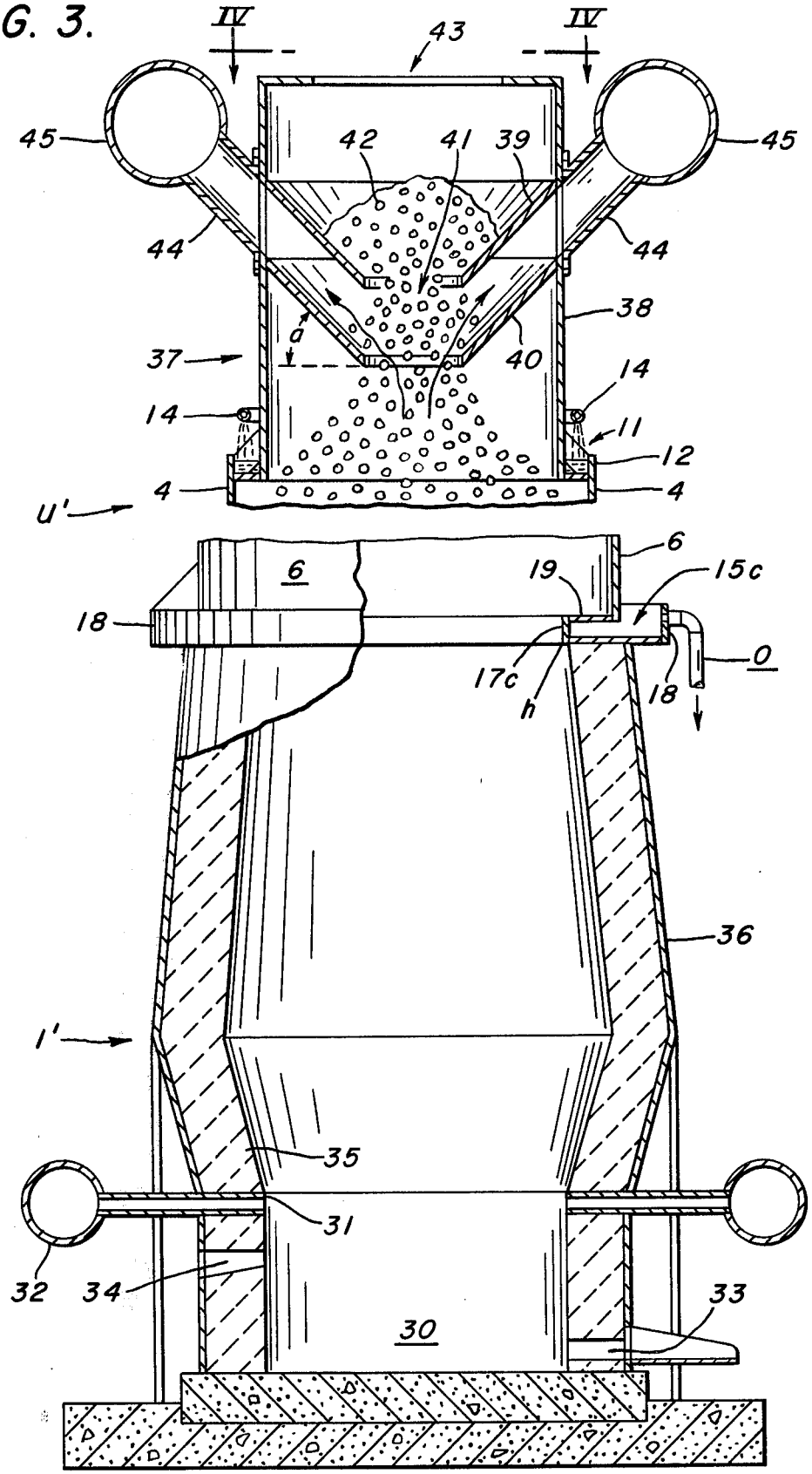
FIG. 3 is a side elevational partial cross-sectional fragmented view of a blast furnace constructed in accordance with the present invention.

In the embodiment illustrated in FIGS. 3 and 4, a blast furnace is shown constructed in accordance with the present invention. The terms "melting portion" and "preheating portion" are used herein to generally describe the lower portion 1' and upper portion *u'* of the blast furnace, although such terminology may not necessarily be consistent with blast furnace technology.

The blast furnace has at the lower portion 1', a conventional hearth 30, with tuyeres 31 being fed through bustle pipe 32. A tap hole 33 and slag hole 34 provided. The lower portion is provided with a refractory lining 35, with a metal shell 36, preferably water cooled.

Atop the lower portion 1', the stack, or upper portion *u'* of the furnace, is constructed in accordance with the construction of the upper portion *u* described in FIGS. 1 and 2 except that a novel charging portion 37 is provided. The upper portion *u'*, except for the charging portion 37, is similar to that of the furnace illustrated in FIGS. 1 and 2, with channel 11 fed with water from water jets 14, and with wall 12 connecting the charging section 37 with the adjacent section 4 of the upper portion *u'*. The construction intermediate the charging portion 37 and the lowermost portion 6 is constructed in accordance with the description of the embodiment of FIGS. 1 and 2, and is not illustrated herein, with water flowing from channel 11 down the sides of the furnace, to the various troughs 15*a*, 15*b*, and 15*c*, with the water from trough 15*c* finally being discharged through outlet *o*. This arrangement is not shown in detail as it is similar to that previously described, with use of a novel charging section arrangement 37.

As illustrated, the charging section 37 has a wall 38 which has attached thereto a pair of spaced concentric rings 39 and 40 which extend downwardly and inwardly from the wall 38 towards the axis of the wall, the rings having a charging opening 41 through which burden 42 to the furnace is fed, which burden is initially fed through an opening 43 at the top of the charging section 37. Exhaust conduits 44 extend through the wall 38 intermediate the pair of spaced discs 39 and 40 to exhaust hot gases from the furnace, the exhaust conduits 44 leading to a bustle pipe arrangement 45 which then exhausts the hot gases through exhausts 46 for discharge or reuse.

The spaced discs 39 and 40, as described, extend inwardly and downwardly from the wall 38 at an angle *a* from the horizontal which is greater than the angle of repose of the burden charged to the furnace such that the burden will flow downwardly through opening 41 and into the area below the discs.

In operation of the charging section 37, burden 42 is charged to the furnace through opening 43, with the burden filling the furnace until burden is supported above the discs 39 and 40. Thus, hot gases passing upwardly through the furnace will flow through the opening surrounded by ring 40 and outwardly between rings 39 and 40 due to the resistance of the burden 42 situate above the two rings. In this manner, hot gases are discharged through conduits 44, bustle pipe arrangement 45 and exhaust 46 while burden is continuously passed downwardly through the openings of rings 39 and 40 and into the furnace.

I claim:

1. In a metallurgical shaft furnace adapted to the production of molten metal from a charge, the furnace comprising an upper preheating portion and a lower melting portion terminating at its bottom in a hearth and having tuyeres therein, the improvement wherein a. the upper portion is comprised of concentric sections, each said section increasing in diameter with respect to an adjacent section from the upper charging section thereof to the lower melting portion, the charging section having an exhaust means and charging means, and a water channel at the lower portion thereof and means for feeding water to said channel, with other of adjacent said sections having a water trough therearound on the outer surface, said trough extending inwardly to form a cooling ring, each said cooling ring increasing in diameter from the section below the charging section to said lower melting portion, said cooling rings providing support for a portion of the charge to the furnace so as to divert hot gases to the center of the furnace for preheating of the charge therein.

2. The metallurgical shaft furnace of claim 1 wherein said means for feeding water to said channel is arranged so as to feed water in a tangential stream into the channel.

3. The metallurgical shaft furnace of claim 1 wherein said channel has a serrated wall through which overflow water from the channel will cascade.

4. The metallurgical shaft furnace of claim 1 wherein the walls of said concentric sections are substantially vertical.

5. The metallurgical shaft furnace of claim 1 wherein the lower melting portion has along the inner wall thereof spaced vertical cooling conduits, the major portion of said conduits extending from the upper portion to a position spaced from the hearth, with vertical conduits adjacent the tuyeres being shorter than said major portion of conduits and terminating in a spaced relationship above the tuyeres.

6. The metallurgical shaft furnace of claim 1 wherein the lower melting portion has along the inner wall thereof spaced horizontal cooling conduits.

7. The metallurgical shaft furnace defined in claim 1 wherein said upper preheating portion and lower melting portion are interconnected at a suspension means for suspending the shaft furnace.

8. The metallurgical shaft furnace defined in claim 1 wherein said charging section has a central exhaust conduit therein and charging means surrounding the exhaust conduit.

9. The metallurgical shaft furnace of claim 1 wherein said charging section includes means about the inner periphery thereof for exhausting gases from the furnace.

10. The metallurgical shaft furnace of claim 9 wherein said means for exhausting gases from the furnace comprises a pair of spaced concentric rings extending from the walls of the upper charging section inwardly to the axis thereof, with exhaust conduits extending through the wall to carry the gases from the furnace.

11. The metallurgical shaft furnace of claim 10 wherein said spaced concentric rings are disposed at a downward angle from the wall of the furnace towards the center thereof.

12. The metallurgical shaft furnace of claim 11 wherein said concentric rings comprise upper and lower rings and wherein said upper ring is discontinuous about said wall.

13. In a metallurgical shaft furnace adapted to the production of molten metal from a charge, the furnace comprising an upper preheating portion and a lower melting portion terminating at its bottom in a hearth and having tuyeres therein and suspension means intermediate the upper and lower portions for suspending said shaft furnace, the improvement wherein a. the upper portion is comprised of concentric sections, each said section increasing in diameter with respect to an adjacent section from the upper charging section thereof to the suspension means, the charging section having a central exhaust conduit therein and charging means surrounding the exhaust conduit and a water channel at the lower portion thereof and means for feeding water to said channel, with other of adjacent said sections having a water trough therearound on the outer surface, said trough extending inwardly to form a cooling ring, each said cooling ring increasing in diameter from the section below the charging section to said suspension means, said cooling rings providing support for a portion of the charge so as to divert hot gases to the center of the furnace for exhaust through the exhaust conduit.

14. The metallurgical shaft furnace of claim 13 wherein the lower portion has along the inner wall thereof spaced vertical cooling conduits, the major portion of said conduits extending from adjacent the suspension means to a position spaced from the hearth, with vertical conduits adjacent the tuyeres being shorter than said major portion of conduits and terminating in a spaced relationship above the tuyeres.

15. The metallurgical shaft furnace of claim 13 wherein the lower portion has along the inner wall thereof spaced horizontal cooling conduits.

16. The metallurgical shaft furnace of claim 15 wherein said spaced horizontal cooling conduits are in the form of a helix.

* * * * *